US012369737B2

(12) United States Patent
Kutas

(10) Patent No.: US 12,369,737 B2
(45) Date of Patent: Jul. 29, 2025

(54) HOME WALL INSERT MAILBOX WITH CONVENIENT BOX TRANSFER FEATURES

(71) Applicant: Jeffrey Robert Kutas, Granbury, TX (US)

(72) Inventor: Jeffrey Robert Kutas, Granbury, TX (US)

( * ) Notice: Subject to any disclaimer, the term of this patent is extended or adjusted under 35 U.S.C. 154(b) by 0 days.

(21) Appl. No.: 18/100,095

(22) Filed: Jan. 23, 2023

(65) Prior Publication Data

US 2023/0233010 A1 Jul. 27, 2023

Related U.S. Application Data

(60) Provisional application No. 63/302,464, filed on Jan. 24, 2022.

(51) Int. Cl.
*A47G 29/28* (2006.01)
*A47G 29/16* (2006.01)
*A47G 29/20* (2006.01)

(52) U.S. Cl.
CPC ..... *A47G 29/28* (2013.01); *A47G 29/16* (2013.01); *A47G 29/20* (2013.01)

(58) Field of Classification Search
CPC ..... A47G 29/28; A47G 29/16; A47G 29/141; A47G 29/20; A47G 29/22; A47G 2029/145; E06B 7/32; E05G 7/00
See application file for complete search history.

(56) References Cited

U.S. PATENT DOCUMENTS 908,543 A 1/1909 Brown
1,810,769 A 6/1931 Jaden
2,703,200 A 3/1955 Burbank
2,760,721 A 8/1956 Roberts
4,186,869 A 2/1980 Brown
4,757,942 A 7/1988 Young, Jr.
4,932,587 A 6/1990 Robbins
5,137,212 A 8/1992 Fiterman et al.
5,435,484 A 7/1995 Carlson
5,449,111 A 9/1995 Sauzedde et al.
(Continued)

FOREIGN PATENT DOCUMENTS

GB 621528 A 4/1949

OTHER PUBLICATIONS

International Search Report PCT/US2018/036879.
Supplementary European Search Report EP 18 81 8819.

*Primary Examiner* — William L Miller
(74) *Attorney, Agent, or Firm* — Optima Law Group, APC; Thomas E. Jurgensen

(57) ABSTRACT

The present invention teaches a residential wall penetrating mailbox with enhanced box handling capability, openable by barcode scanning, and openable from either inside or outside a home. A body which is generally column shaped has a front door which open at the top and hinge near the bottom and which has transfer means extending from the bottom and interior end of the front door into the interior space of the mailbox, said transfer means transferring and moving boxes away from the mailbox into the interior of the home. Thus, a delivery person may access a box from outside the home, while the homeowner may do the same without leaving the safety of the home interior while allowing for multiple boxes to move in the safety of the interior or the home.

4 Claims, 7 Drawing Sheets

(56) References Cited

U.S. PATENT DOCUMENTS 5,938,113 A 8/1999 Kim
6,375,071 B1 4/2002 Kim
6,378,767 B1 * 4/2002 Steele ..... A47G 29/22 232/19
6,415,552 B1 * 7/2002 Khosropour ..... F25D 23/12 52/27
6,483,433 B2 11/2002 Moskowitz et al.
6,719,195 B2 * 4/2004 Farentinos ..... A47G 29/22 232/47
6,879,255 B1 4/2005 Jezierski
6,987,452 B2 1/2006 Yang
7,123,147 B2 10/2006 Engel
7,252,220 B1 8/2007 Shreve
7,320,427 B2 1/2008 Prestwich
7,337,944 B2 3/2008 Devar
7,516,880 B1 4/2009 Crain et al.
7,843,340 B2 11/2010 Davis
7,854,374 B2 12/2010 Dudley
7,946,472 B2 5/2011 Bolles
8,261,966 B2 9/2012 Cox et al.
8,299,923 B2 10/2012 Hammoud
8,573,473 B1 11/2013 Farentinos et al.
9,004,346 B2 4/2015 Farentinos et al.
10,517,417 B2 * 12/2019 Kutas ..... A47G 29/12095
10,799,050 B1 * 10/2020 Glaser ..... A47G 29/20
10,881,233 B1 * 1/2021 Walsh ..... E06B 7/32
10,954,068 B2 * 3/2021 Nevison ..... G05B 15/02
11,033,136 B2 6/2021 Kutas et al.
11,478,099 B1 * 10/2022 Bates ..... A47G 29/141
11,587,382 B1 * 2/2023 Valentine ..... G07C 9/00896
11,812,878 B1 * 11/2023 Nevison ..... H04L 9/0643
11,896,151 B2 * 2/2024 Myrick ..... A47G 29/30
11,918,131 B2 * 3/2024 Lee ..... F25D 23/10
11,928,642 B2 * 3/2024 Ruocco ..... G07C 9/00896
2001/0035703 A1 * 11/2001 Scholefield ..... F25D 23/10 312/242
2003/0006275 A1 * 1/2003 Gray ..... A47G 29/14 232/19
2004/0211827 A1 10/2004 Gunvaldson
2008/0067227 A1 3/2008 Poss et al.
2010/0127063 A1 5/2010 Bolles
2011/0084123 A1 4/2011 Cox et al.
2011/0210166 A1 9/2011 Dinh
2013/0020384 A1 1/2013 Corey
2015/0021386 A1 1/2015 Farentinos et al.
2017/0143146 A1 * 5/2017 Charbeneau ..... A47G 29/141
2017/0156533 A1 6/2017 Pajonas
2017/0213187 A1 * 7/2017 Choi ..... H04N 7/181
2018/0199745 A1 * 7/2018 Charbeneau ..... A47G 29/141
2018/0317687 A1 * 11/2018 Crooks ..... A47G 29/22
2018/0352987 A1 * 12/2018 Kutas ..... A47G 29/16
2019/0248582 A1 * 8/2019 Nevison ..... A47G 29/20
2019/0254459 A1 * 8/2019 Hengst ..... A47G 29/141
2019/0316411 A1 * 10/2019 Vanek ..... E06B 7/32
2020/0085222 A1 * 3/2020 Kutas ..... A47G 29/141
2020/0154922 A1 * 5/2020 Jeffs ..... A47G 29/28
2020/0271358 A1 * 8/2020 Oh ..... F25D 31/005
2020/0308903 A1 * 10/2020 Anderson ..... E05F 15/76
2020/0352376 A1 * 11/2020 Vernal Silva ..... A47G 29/1254
2021/0005033 A1 * 1/2021 Roman ..... G06Q 10/0833
2021/0045564 A1 * 2/2021 Duckers ..... E05D 15/264
2021/0059456 A1 * 3/2021 Fontanilla ..... A47G 29/16
2021/0079720 A1 * 3/2021 Hunt ..... E06B 7/28
2021/0106160 A1 * 4/2021 Janas ..... A47G 29/30
2021/0177182 A1 * 6/2021 Plummer ..... A47G 29/28
2021/0230926 A1 * 7/2021 Schler ..... E05F 15/77
2022/0039581 A1 * 2/2022 Lee ..... A47G 29/30
2022/0125230 A1 * 4/2022 Jordan ..... A47G 29/141
2022/0151419 A1 * 5/2022 Lee ..... G07C 9/00912
2022/0155005 A1 * 5/2022 Lee ..... G06Q 10/06316
2023/0153747 A1 * 5/2023 Ruocco ..... G06Q 10/0836 232/31
2023/0404308 A1 * 12/2023 Balding ..... E06B 7/32

* cited by examiner

HOME WALL INSERT MAILBOX WITH CONVENIENT BOX TRANSFER FEATURES

FIELD OF THE INVENTION

The present invention relates generally to mailboxes and more specifically to home wall penetrating mailboxes with expanded box handling and transfer features.

BACKGROUND

Residential home mailboxes of the wall mounted type are usually either a simple slot with a covering flap which penetrates a door, or they are mounted on the exterior of the home only. For the first type, the mail delivery person slides letters through the slot, and the home owner finds the letters laying on the floor inside the door when they return home. For the latter type, the mail delivery person puts letters into the box hanging on the outside of the wall of the house and the resident checks the mail by walking outside to the mailbox. This latter type can also be mounted on a small pole or the like.

However, both of these types have numerous disadvantages.

In the case of the slot type, packages cannot really be used with the slot. Normally packages are simply left on a front porch, with the risks of theft, weather damage and animal interest all inherent in this procedure. Also, it is often true that as the door swings open the mail on the floor is crumpled, ripped, or otherwise damaged. Finally, the homeowner probably does not really enjoy bending over and scraping their mail off their floor with their fingernails every day. (For this reason, some slot types mail boxes penetrate a house wall instead of a door, and may feature a small shelf on the interior wall which tends to retain most letters shoved through the slot.)

In the case of the external mail box on the other hand, the mail box is at least normally mounted a bit off the ground, for convenient access. However, the space inside of the box is usually limited. Some exterior-wall-hung mailboxes are barely longer than a business size envelope and only a few inches deep and wide, making their effective capacity smaller than a door slot type. Once again, delivered packages are just left on a front porch, again with the risks of theft, weather damage and animal interactions.

Noticeably, neither type will handle a package much larger than an envelope.

Homeowners of curbside mailboxes experience other problems. One very common issue, especially in the age of constant on-line ordering, is the irritation surrounding return of packages which do not fit in the standard size of curbside mailbox. A purchaser who wishes to return a product via mail will have to go online, get a mailing label from the seller, and then notify the mail delivery person (via a note on the curbside box or whatever) that they have a box which needs to be returned. Also, packages have to be retrieved via the street side of the box and so forth.

It would be preferable to provide a residential home mailbox which works to provide indoor or outdoor access to packages, provides a safe place for packages to be stored out of the elements, locked, and inaccessible and allows for the transfer and ready movement of packages to accommodate the large number of packages typically obtained today.

It would further be preferable to provide a residential home mailbox which allows a mail delivery person to access packages within the box without need for a special key and to have transferred packages be securely maintained, e.g., within the home or garage of a user.

US Patent Application Publication No. 2008/0067227, published Mar. 20, 2008 in the name of Poss et al, teaches a package deposit enclosure for public use, not residential use. It lacks the ability to lift packages in either direction when opened, to scan barcodes for entry and modular renovation and improvement.

U.S. Pat. No. 8,261,966 issued Sep. 11, 2012 in the name of Cox et al, teaches a residential mailbox having a column style mailbox with various doors and supports but no indication of easy renovation and modular improvement.

U.S. Pat. No. 7,854,374 issued Dec. 21, 2010 in the name of Dudley, teaches at least multiple mail handling compartments and multiple doors for convenient access in different ways. However, it lacks the ability to lift packages from the bottom for easy handling from either side.

U.S. Pat. No. 6,987,452 issued Jan. 17, 2006 in the name of Yang teaches an "iBox", an intelligent mailbox having communication capabilities but lacking basic mail handling functions, the ability to be easily accessed from either curbside or sidewalkside, does not cooperate with barcodes and so on.

U.S. Pat. No. 6,879,255 issued Apr. 12, 2005 in the name of Jezierski teaches a mailbox cam retrofit to a traditional mailbox, which transmits an image from the box, but which lacks security features for the homeowner's security (rather than just box security), and does not teach any usability with bar codes, lacks a scanner, lacks convenience features for the curbside/sidewalkside problem and so on.

U.S. Pat. No. 6,483,433 issued Nov. 19, 2002 in the name of Moskowitz et al teaches a computer system for determining if a package has been placed in a depository, but lacks any physical mail box structure.

U.S. Pat. No. 11,033,136 issued Jun. 15, 2021 in the name of Kutas et al. teaches an in-wall mailbox but lacks a means to accommodate large and numerous packages in a secure manner.

It would be preferable to provide a mail box which has none of these limitations.

It would further be preferable to provide a mail box which can be easily semi-customized or renovated in a modular manner to a higher level of structural features and capabilities.

SUMMARY OF THE INVENTION

The present invention teaches a residential home wall insert mailbox with enhanced box handling capability, openable by barcode scanning, which can be accessed by delivery persons outside the wall of the home or by the homeowner inside the home and provides for the movement and transfer of packages within the security of the home to accommodate a large and growing number of packages being delivered today.

A body which is generally column-shaped has front and rear sides having a front door which open at the top and hinge near the bottom. The body is placed in the wall of a home to allow packages to be delivered from one door on the outside of the house and retrieved from a different door on the inside of the house, typically a garage or utility room. A bonnet caps the columnar body of the curbside options.

The front door includes side members extending from the inside bottom of the front door to contain a box therein once deposited by a delivery person into the mailbox of the present invention. The inside bottom of the front door also includes a transfer means disposed substantially between the side members. The transfer means serves to move boxes away from the interior of the front door and into the interior of the home, thereby allowing for the delivery of a very large number of boxes at a given time or day(s) while still moving the boxes securely into the interior of the home. The user can also add an extension onto the transfer means to move the boxes further into the interior of the home and to allow for the delivery of even more and bigger boxes. Ideally, the transfer means will be comprised of multiple freely moveable rollers.

An optional letter slot in the mailbox may allow letters to fall to a slanted chute which in turn allows the letters to slide downward into a letter drawer which may be easily withdrawn via the rear door of the mailbox.

These, and other, embodiments of the invention will be better appreciated and understood when considered in conjunction with the following description and the accompanying drawings. It should be understood, however, that the following description, while indicating various embodiments of the invention and numerous specific details thereof, is given by way of illustration and not of limitation. Many substitutions, modifications, additions and/or rearrangements may be made within the scope of the invention without departing from the spirit thereof, and the invention includes all such substitutions, modifications, additions and/or rearrangements.

SUMMARY IN REFERENCE TO THE CLAIMS

It is therefore a first aspect, advantage, objective and embodiment of the present invention to provide a residential mailbox for use with boxes, the residential mailbox for mounting in a home wall having an exterior face and an exterior, and interior face and an interior, the residential mailbox comprising:

- a columnar body having a vertical axis and a front and a back;
- the columnar body mounted into such home wall, with the front passing through such exterior face of such home wall and accessible from such exterior, and with the back passing through such interior face of such home wall and accessible from such interior;
- the front having a door therein, the door forming part of the front when in a closed position, the door having at least one hinge allowing it to move to an open position by swinging outward at a top end;
- the door having at least one side member extending from each bottom side of the door inside of the columnar body;
- a box drawer disposed within the columnar body, resting adjacent to the door and side members when the first door is in the closed position, a center of gravity of the box drawer adjacent to and on the at least one member of each side of the door, whereby the side members of the door provide stable support for the box drawer; and
- a transfer means disposed and connected to the bottom of the inside of the box drawer and optionally to the side members; wherein the transfer means serves to move boxes away from the door and into the interior of the home.

It is therefore another aspect, advantage, objective and embodiment of the present invention to provide a residential mailbox as provided herein, further comprising an extension of the transfer means for moving boxes further within the interior of the home.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION OF DRAWINGS

Glossary

For purposes of this application and claims, the term slightly less than 90 degrees means an angle of 80 to 89.99 degrees.

For purposes of this application and claims, columnar means having the general aspect of a column e.g., being tall and narrow. In the presently preferred embodiments of the present invention, this includes being a generally rectanguloid body oriented with a vertical axis which is longer than the two horizontal axes.

A wall insert mailbox means a mailbox which is not free standing but rather is inserted through the wall of a home so that the front door is on the exterior of the home and the rear door is on the interior of the home (or vice-versa within the claims below). The interior means the inside of the home, while the exterior means outside the home. No claim is made to home interiors nor to home exteriors. The interior face of the wall of the home is that face of the wall which faces the interior, the exterior face obviously faces the exterior. The wall may be solid and still have two faces. No claim is made to walls.

End Glossary

Figure 1:
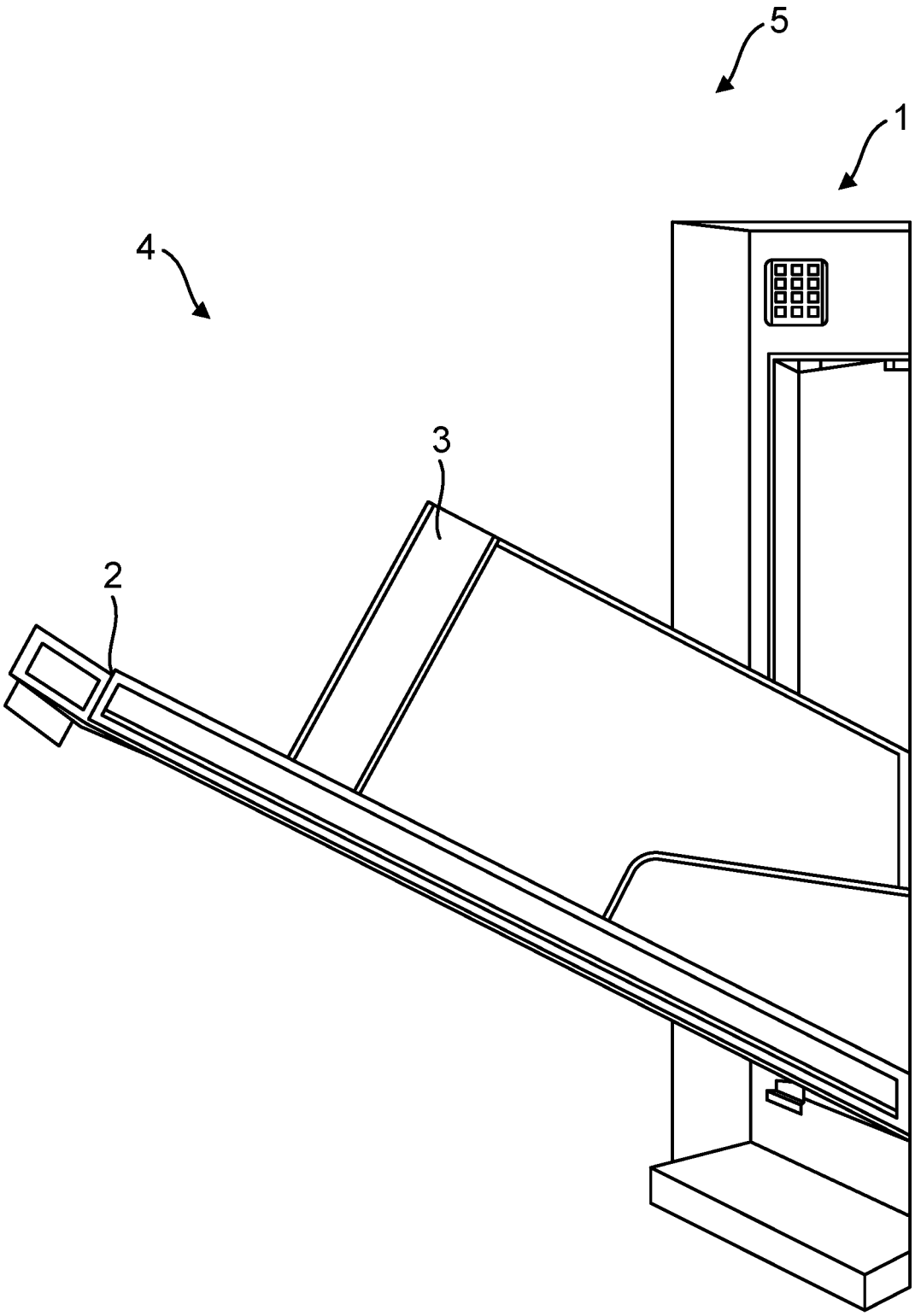
FIG. 1 is a side view of the exterior of the mailbox of the present invention showing the front door in an open position with a box inserted by a deliver person (not shown) for delivery into the interior of a home upon closing of the front exterior door.

FIG. 1 is a side view of the exterior of the mailbox 1 of the present invention showing the front door 2 in an open position with a box 3 inserted by a deliver person (not shown) for delivery into the interior of a home upon closing of the front exterior door 2 The mailbox or wall insert 1 will protrude slightly through a wall or may be inset into the wall with recesses on one or both sides currently shown. The exterior of home 4 and the interior of the home not shown are obviously defined and separated by the exterior wall 5. The construction of the exterior wall 5, or wall in general, is irrelevant to the invention, as thinner walls may allow more projection on one or both sides, while thicker walls may be penetrated by recesses and the mailbox. Materials are also irrelevant and the wall may be wallboard and stringer construction, solid, brick faced, plaster and lathe, etc.

The wall 5 depicted is rather thick, being almost as wide as the mailbox 1, but this is merely exemplary.

Figure 2:
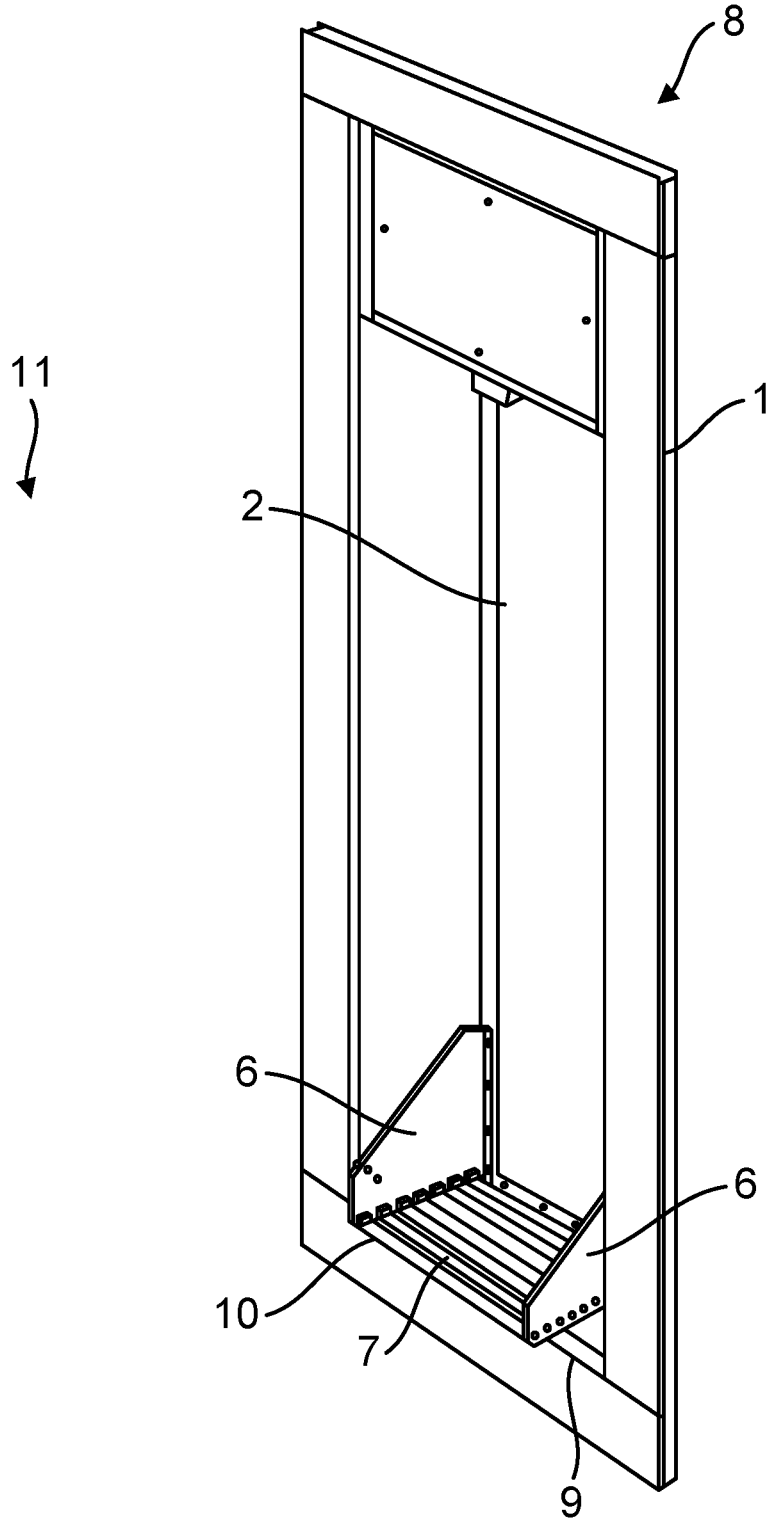
FIG. 2 is a view of the interior of a mailbox insert according to the present invention showing the front door being closed and also showing the details of the side members for containing a box and a transfer means for transport of a box once delivered.

FIG. 2 is a view of the interior of a mailbox 1 insert according to the present invention showing the front door 2 being closed and also showing the details of the side members 6 for containing a box and a transfer means 7 for transport of a box once delivered. The mailbox 1 is also set into the interior wall 8 of the home. As noted, the side members 6 are affixed to the side and bottom of the front door 2 and function to guide a box insert into the mailbox 1 to the bottom of the unit 9 where the transfer means 7 is deployed and attached to the side members 6. As provided in FIG. 2, the transfer means is comprised of multiple rollers 10 that are freely moveable and aligned to efficiently transfer and move any box or package inserted into the mailbox 1 into the interior 11 of the home where they can be securely maintained until retrieved by the occupant.

Figure 3:
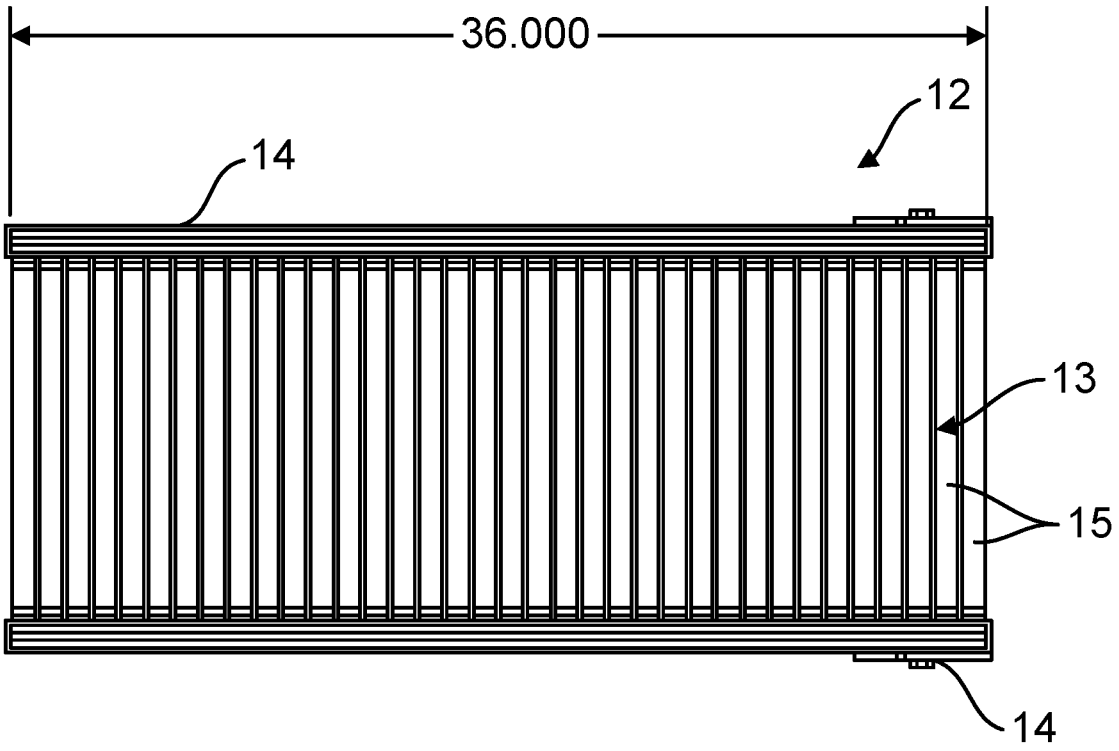
FIG. 3 is a top perspective view of an extension transfer means according to the present invention including multiple in line rollers.

FIG. 3 is a top perspective view of an extension transfer means 12 according to the present invention The transfer means 12 in this embodiment is comprised of side rails 14 containing multiple in line rollers 13 comprised of multiple individual rollers 15 aligned in parallel. The in-line rollers 13 are freely moveable and aligned to efficiently transfer and move any box or package inserted into the mailbox 1 into the interior 11 of the home where they can be securely maintained until retrieved by the occupant. It is understood that the transfer means can be accomplished by any means that moves a box inside and away from the mailbox 1, including for example movable panels sliding in unison to move a package away from the mailbox 1 and into the interior 8 of the home. Other ready means will be readily understood by those skilled in the art and can be simply mechanical or could be powered with motors and electric current be it built in or battery powered.

Figure 4:
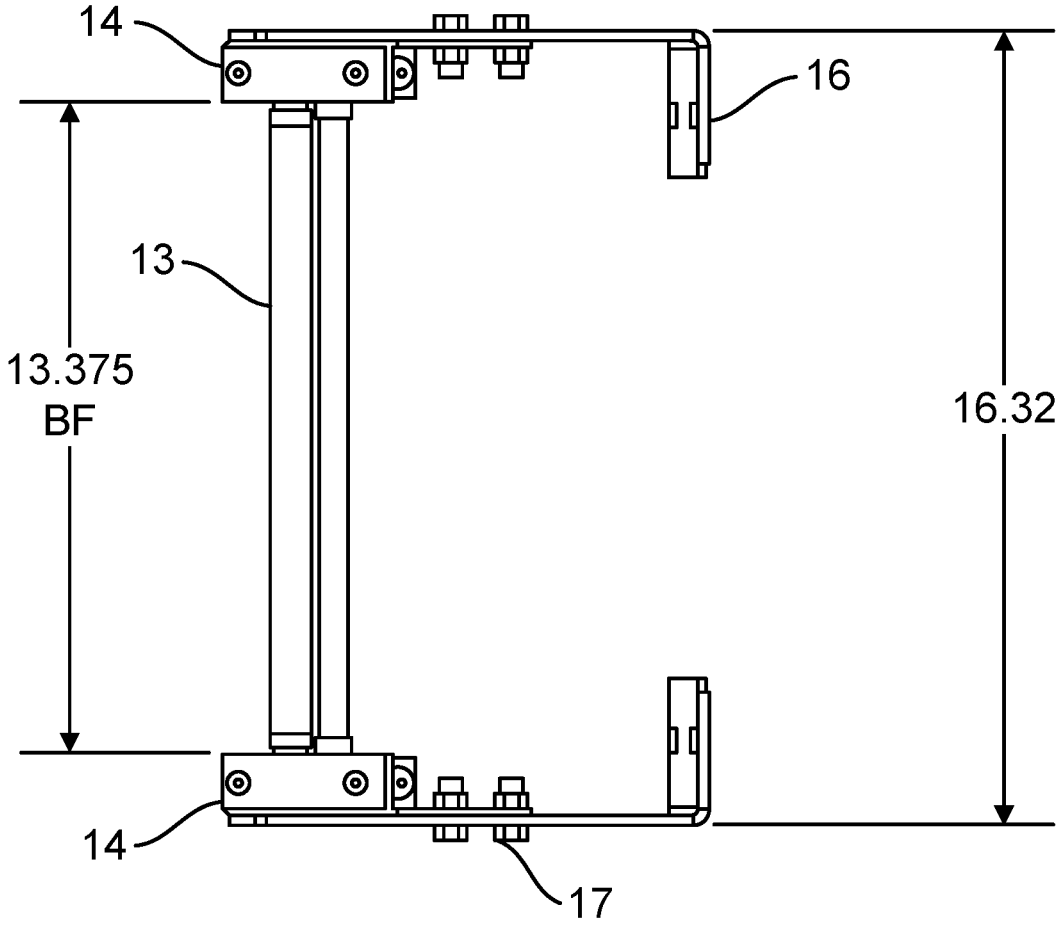
FIG. 4 is an end view of an extension transfer means according to the present invention showing adjustable legs to be used to connect the extension to the transfer means built into the interior of mailbox according to the present invention.

FIG. 4 is an end view of an extension transfer means according to the present invention showing adjustable legs 16 with adjustable elements 17 to be used to place and optionally connect the extension to the transfer means 7 built into the interior of mailbox 1 according to the present invention. The adjustable legs 16 allow for exact alignment and interconnect between the built-in transfer means and the extension transfer means 12, including the side rails 14 and in-line rollers 13.

Figure 5:
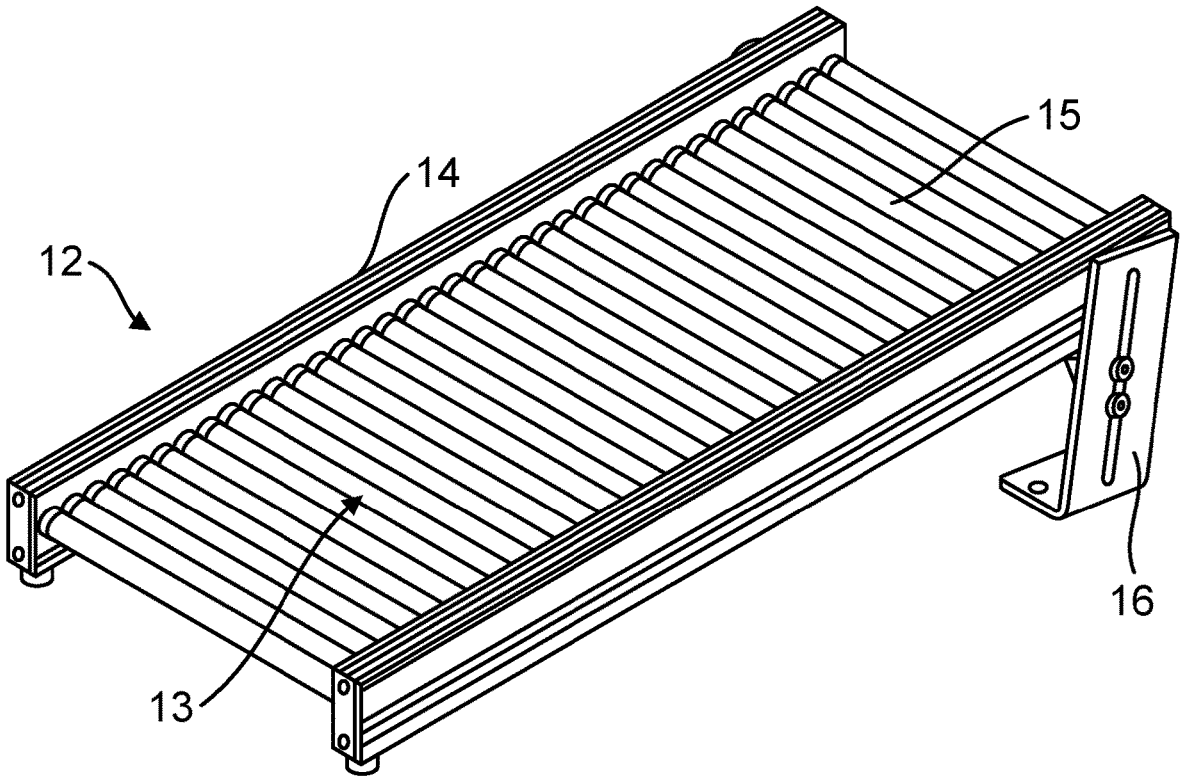
FIG. 5 is top and side perspective view of an extension to the transfer means according to the present invention ready to be connected to the transfer means built into the interior of a mailbox according to the present invention.

FIG. 5 is top and side perspective view of an extension to the transfer means 12 according to the present invention ready to be connected to the transfer means 7 built into the interior of a mailbox 1 according to the present invention. The transfer means 12 in this embodiment is comprised of side rails 14 containing multiple in line rollers 13 comprised of multiple individual rollers 15 aligned in parallel. The extension transfer means 12 is aligned with the built-in transfer means 7 of the mailbox 1 using the adjustable legs 16 with adjustable elements 17.

Figure 6:
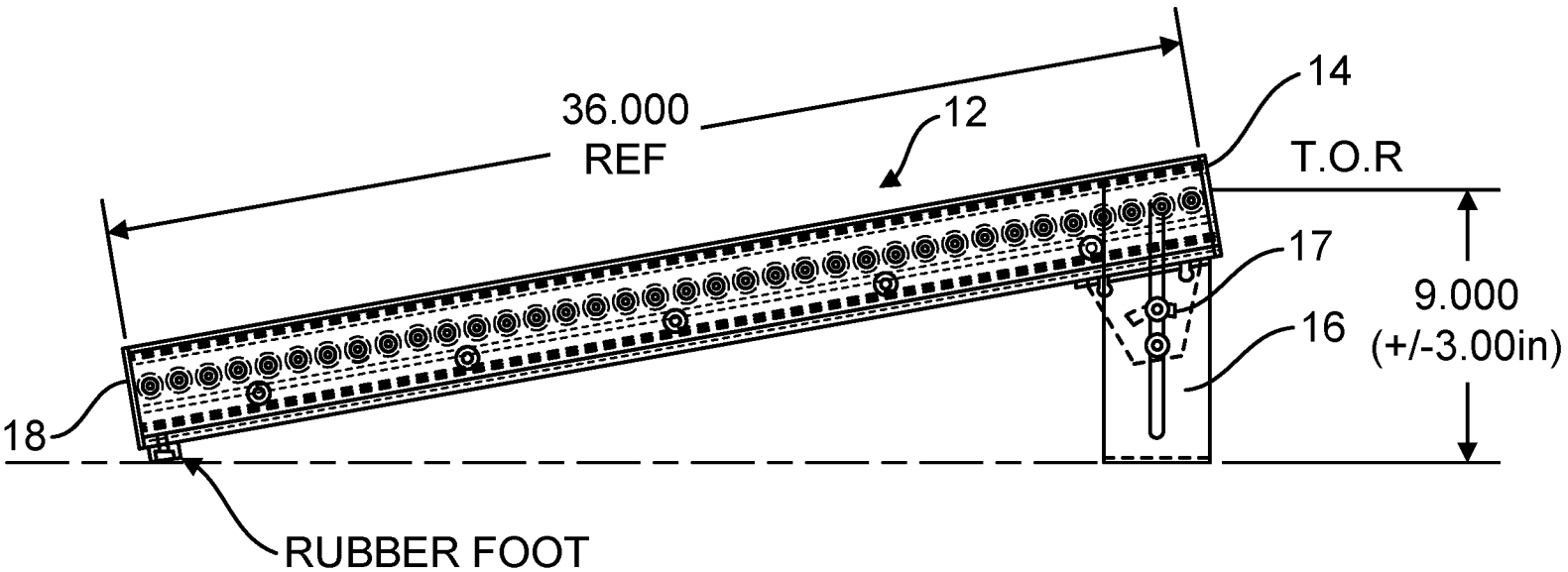
FIG. 6 is a side view of the extension to the transfer means of the present invention showing the transfer extension and adjustable legs.

FIG. 6 is a side view of the extension to the transfer means the extensions transfer means 12 in this embodiment is comprised of side rails 14 containing multiple in line rollers 13 comprised of multiple individual rollers 15 aligned in parallel 12 of the present invention showing the transfer extension 12 and adjustable legs 16 with adjustable elements 17. As shown herein, there are ends of the roller are shown aligned by their ends 18 contained within the side rails 14 of the extension transfer means 12.

Figure 7:
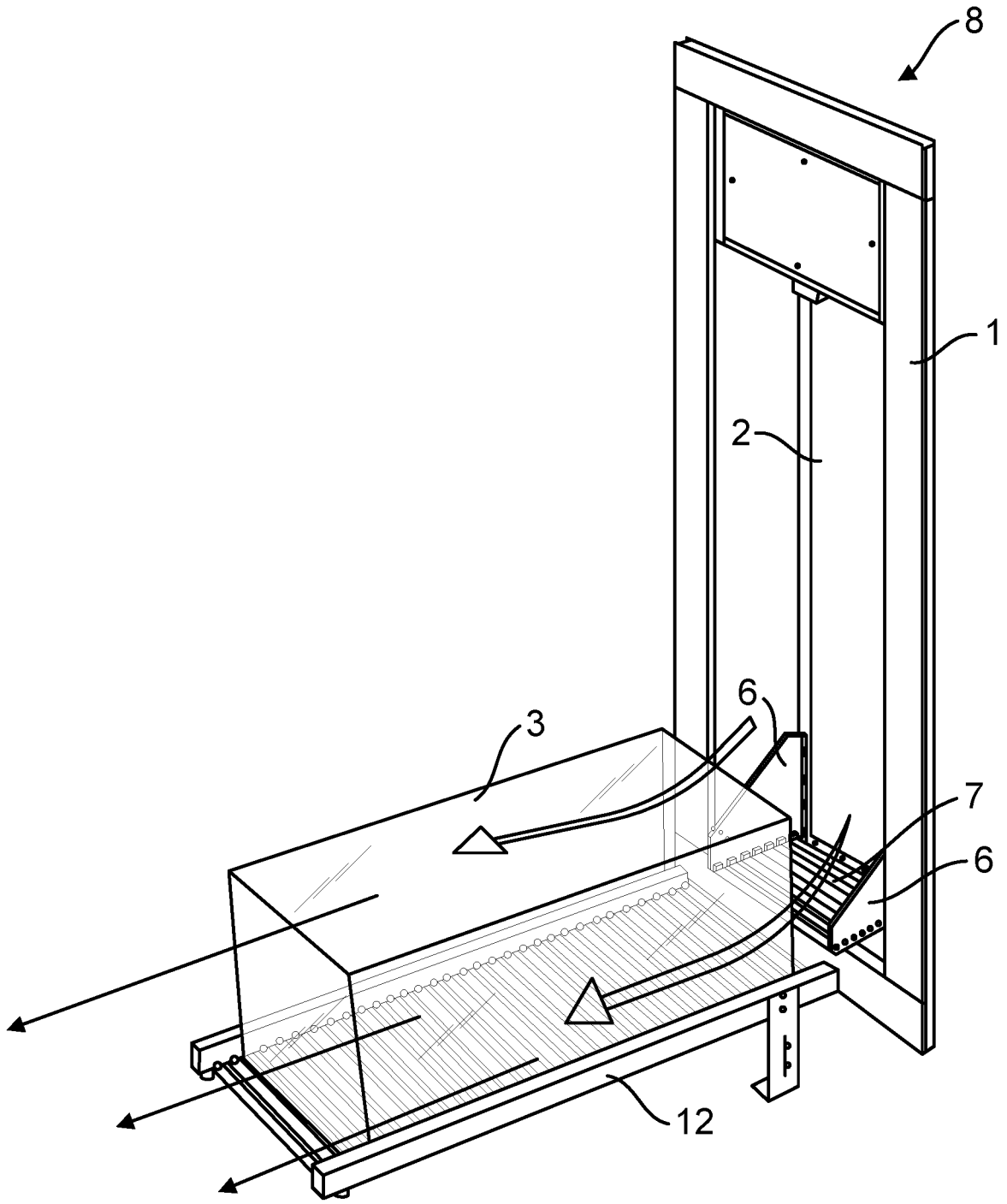
FIG. 7 is a perspective view of the interior of an insert mailbox according to the present invention showing how a box would be delivered in the mailbox and transferred to the interior of the home using the built-in transfer means and extension transfer means according to the present invention.

FIG. 7 is a perspective view of the interior of an insert mailbox 1 according to the present invention showing how a box 3 would be delivered in the mailbox 1 and transferred to the interior 11 of the home using the built-in transfer means 7 and extension transfer means 12 according to the present invention. As noted, any box 3 deposited into the mailbox 1 by a delivery person or otherwise will move from the built-in transfer means 7 onto the extension transfer means 12 moving a box 3 into the interior of the home 8. Thus, the mailbox 1 of the present invention allows for very large deliveries of multiple boxes 3 and other packages into the interior 8 of a home or garage over any defined period of time.

Throughout this application, various publications, patents, and/or patent applications are referenced in order to more fully describe the state of the art to which this invention pertains. The disclosures of these publications, patents, and/or patent applications are herein incorporated by reference in their entireties, and for the subject matter for which they are specifically referenced in the same or a prior sentence, to the same extent as if each independent publication, patent, and/or patent application was specifically and individually indicated to be incorporated by reference.

It will be understood that references to "curbside" mailboxes, bonnets, tops, items on the side and so forth are for the curbside embodiment.

Methods and components are described herein. However, methods and components similar or equivalent to those described herein can be also used to obtain variations of the present invention. The materials, articles, components, methods, and examples are illustrative only and not intended to be limiting.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art.

Having illustrated and described the principles of the invention in exemplary embodiments, it should be apparent to those skilled in the art that the described examples are illustrative embodiments and can be modified in arrangement and detail without departing from such principles. Techniques from any of the examples can be incorporated into one or more of any of the other examples. It is intended that the specification and examples be considered as exemplary only, with a true scope and spirit of the invention being indicated by the following claims.

What is claimed is:

1. A residential mailbox for use with packages, the residential mailbox for mounting in a home wall, the home wall having an exterior face at an exterior of the home, and interior face in an interior of the home, the residential mailbox comprising:

a columnar body having a vertical axis and a front and a back;

the columnar body mounted into the home wall, with the front passing through the exterior face of the home wall and accessible from the exterior, and with the back passing through the interior face of the home wall and accessible from the interior;

the front having a door therein, the door including a front exterior side, a rear interior side, a top edge, a bottom edge, and two opposing side edges extending between the top edge and the bottom edge, the door forming part of the front when in a closed position, the door having at least one hinge at the bottom edge thereof allowing it to move to an open position by swinging outward toward the exterior at the top edge thereof;

the door further including a side member extending from each opposing side edge of the door inside of the columnar body toward the interior, and a bottom member extending from the bottom edge of the door inside of the columnar body toward the interior, wherein the side members and the bottom member form a box drawer within the columnar body when the door is in the closed position;

transfer means disposed and connected to a top side of the bottom member and interior sides of the side members of the door; and further wherein the transfer means serves to move packages away from the door and into the interior of the home.

2. The residential mailbox of claim 1, further comprising an extension transfer means attached to the transfer means for moving packages further within the interior of the home.

3. The residential mailbox of claim 2, wherein the extension transfer means comprises freely moveable rollers for moving packages further within the interior of the home.

4. The residential mailbox of claim 1, wherein the transfer means comprises freely moveable rollers that move and transfer packages away from the door and into the interior of the home.

* * * * *